US011213154B1

(12) United States Patent
Timothy

(10) Patent No.: US 11,213,154 B1
(45) Date of Patent: Jan. 4, 2022

(54) APPARATUS FOR ASSISTING A USER TO WEAR AN APPAREL

(71) Applicant: James B. Timothy, Arkport, NY (US)

(72) Inventor: James B. Timothy, Arkport, NY (US)

( * ) Notice: Subject to any disclaimer, the term of this patent is extended or adjusted under 35 U.S.C. 154(b) by 149 days.

(21) Appl. No.: 16/580,275

(22) Filed: Sep. 24, 2019

(51) Int. Cl.
*A47G 25/90* (2006.01)

(52) U.S. Cl.
CPC ..... *A47G 25/90* (2013.01)

(58) Field of Classification Search
CPC ..... A47G 25/90; A47G 25/905; A47G 25/907
See application file for complete search history.

(56) References Cited

U.S. PATENT DOCUMENTS 4,898,309 A * 2/1990 Fischer ..... A47G 25/904 223/111
5,630,534 A * 5/1997 Maier ..... A47G 25/905 223/111
7,070,074 B2 * 7/2006 Landsberger ..... A47G 25/905 223/111
8,215,524 B1 * 7/2012 Swisher ..... A47G 25/908 223/111
8,657,165 B1 * 2/2014 Liu ..... A47G 25/905 223/111
9,282,840 B2 * 3/2016 Moscato ..... A47G 25/907
9,445,680 B2 * 9/2016 Bean ..... A47G 25/80
10,292,517 B1 * 5/2019 Lawver ..... A47G 25/90
2010/0078450 A1 4/2010 Longhurst
2017/0105561 A1 * 4/2017 Cooper ..... A47G 25/90

FOREIGN PATENT DOCUMENTS

FR 2921552 A1 * 4/2009

* cited by examiner

*Primary Examiner* — Ismael Izaguirre
(74) *Attorney, Agent, or Firm* — Sanchelima & Associates, P.A.; Christian Sanchelima; Jesus Sanchelima

(57) ABSTRACT

A system for an apparatus for assisting a user in donning an apparel is disclosed herein. The apparatus comprises a first brace element and a second brace element that is connectable to the first brace element. These supports allow for mounting a garment thereon for allowing a user to insert their feet through a garment foot opening while the garment is held by the first brace element and the second brace element. A handle is mounted to the brace elements and is used for pulling up the brace elements having the garment installed thereon, thereby assisting the user in getting dressed.

8 Claims, 5 Drawing Sheets

APPARATUS FOR ASSISTING A USER TO WEAR AN APPAREL

BACKGROUND OF THE INVENTION

1. Field of the Invention

The present disclosure relates to the field of assist devices for donning apparels. In particular, the present disclosure relates to the field of assist devices for donning apparels such as pants, shorts, and the like.

2. Description of the Related Art

Individuals with low mobility, either from old age or any other form of ailments typically find it difficult to put on apparels such as pants, shorts, and the like mainly because of the movement that is required in donning them. Such individuals typically need the help of a care-person to don the aforementioned apparels. As such, there is need for a device or an apparatus that can help such individuals to perform the task of putting on their clothes with complete independence.

Several designs for devices for assisting users in donning apparels have been designed in the past. None of them, however, include a device for aiding in in donning clothing comprising a pair of semi-cylindrical foot and shin covers, which are joined by a coupling member attached to the mid-point of each foot cover. The present invention functions through a simple operation which allows the user to don the apparel easily and quickly by allowing the user to insert their feet in a foot accommodating region and pulling the device from there, thus requiring minimal movement of the legs. Once the user has mounted their desired garments over the present invention. The user can then pull the present invention up towards their waist area to get dress. Upon doing so the user is assisted in getting dressed by the present invention without needing to preform otherwise uncomfortable body movements. Garments such as pants, underwear or shorts can be donned by the present invention.

Applicant believes that a related reference corresponds to U.S. Patent Publication No. US20100078450 filed by James E. Longhurst. The Longhurst reference discloses a device used for assisting a person in putting on pants. In its preferred embodiment the device is generally comprised of a non-flexible beam, a plurality of clips, two ropes and two handles. The beam has two ends and each rope is attached to each end of the beam. Each rope terminates at a soft, rubberized handle. The clips are attached to the beam in a downward facing manner by clip attachments. Clips then attach to the person's pair of pants for use. However, the device disclosed in the Lonhhurst reference fails to disclose feet accommodating region that allows a user to pull the device from there, thus requiring minimal movement of the legs while wearing the apparel.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an apparatus for assisting a user to don an apparel having a simple operation which allows the user to wear the apparel easily and quickly.

It is an object of the present invention to provide an apparatus for assisting a user to don an apparel that allows the user to insert their feet in a feet accommodating region of the apparatus and pulling the device up from there, thus requiring minimal movement of the legs or body while getting dressed to wear the apparel.

Further objects of the invention will be brought out in the following part of the specification, wherein detailed description is for the purpose of fully disclosing the invention without placing any limitations thereon.

BRIEF DESCRIPTION OF THE DRAWING

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
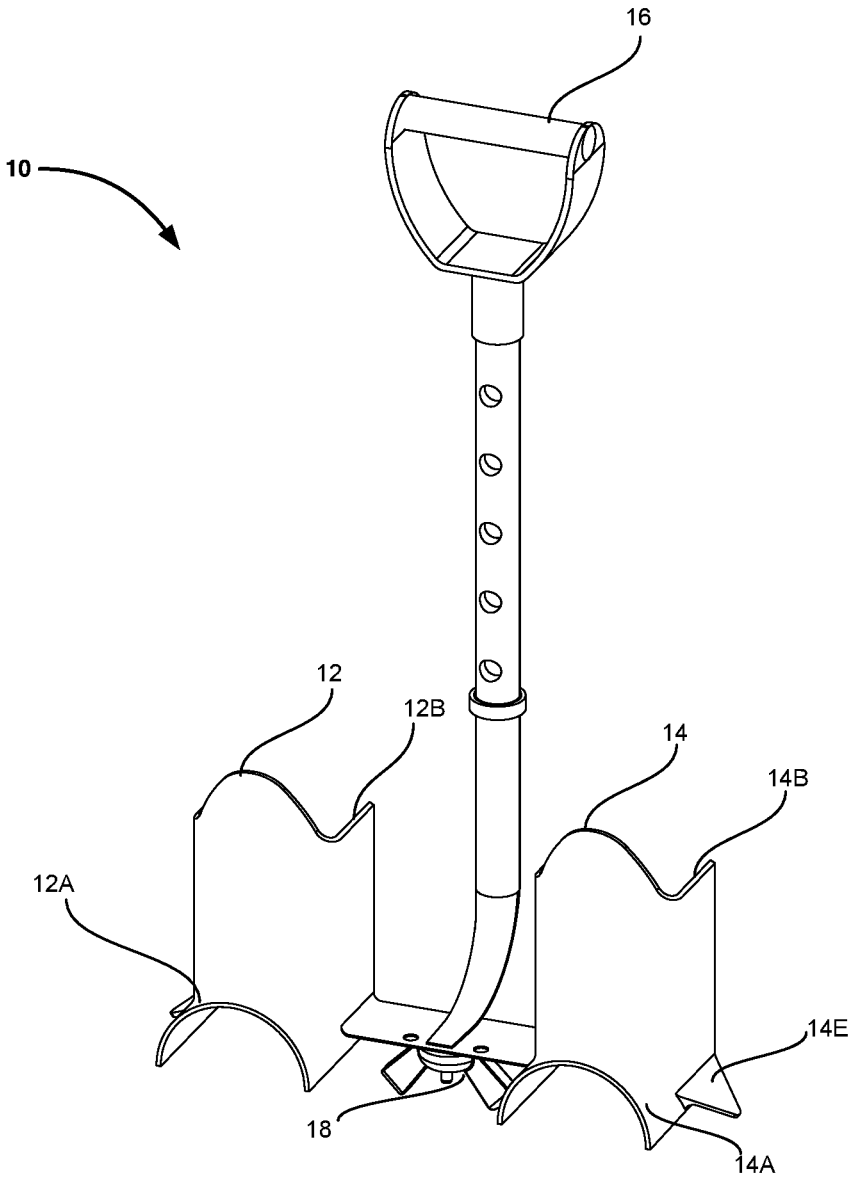
FIG. 1 illustrates an isometric view of an apparatus for assisting in donning apparels 10, in accordance with an embodiment of the present invention.
Figure 2:
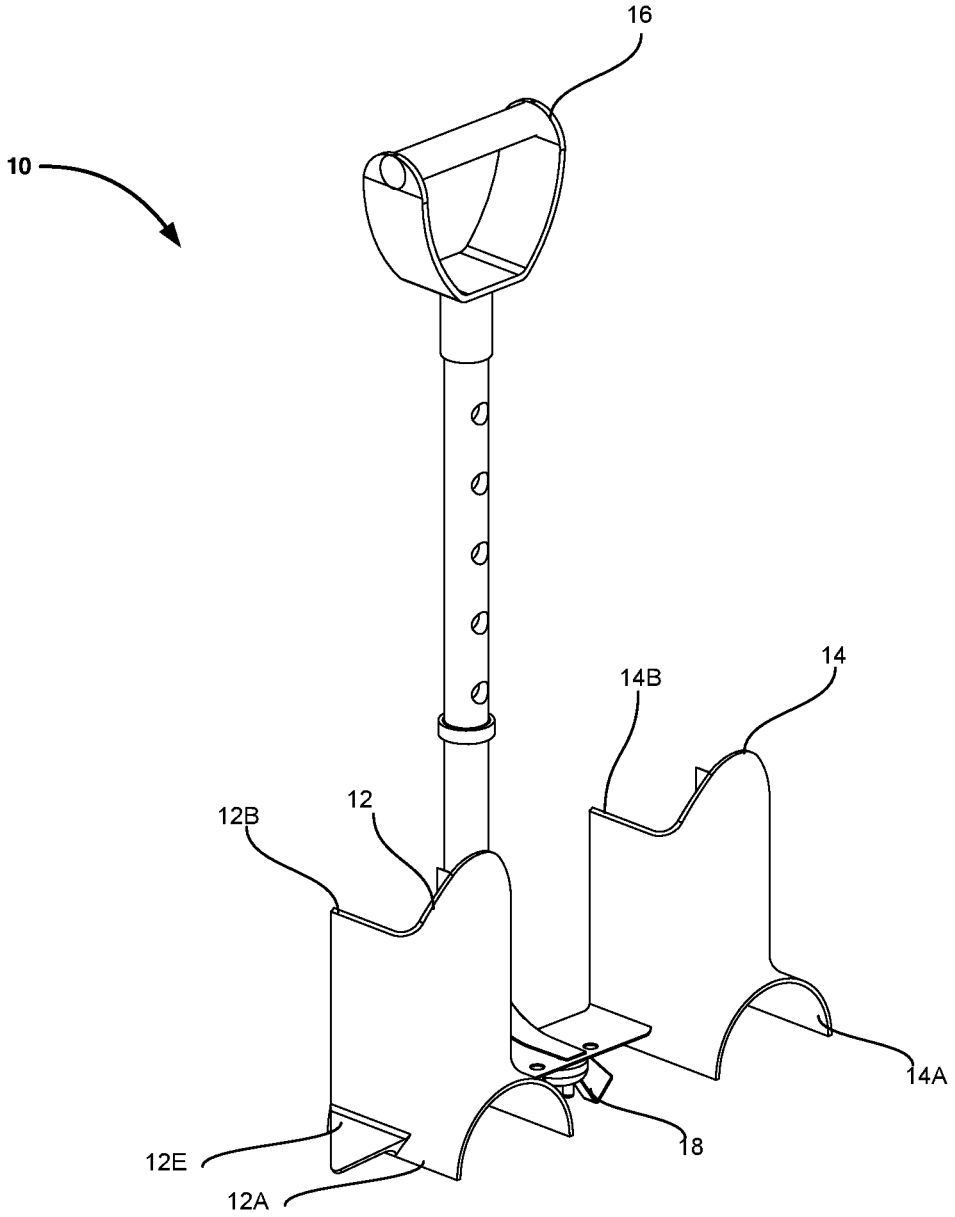
FIG. 2 illustrates another isometric view of apparatus 10, in accordance with an embodiment of the present invention.
Figure 3:
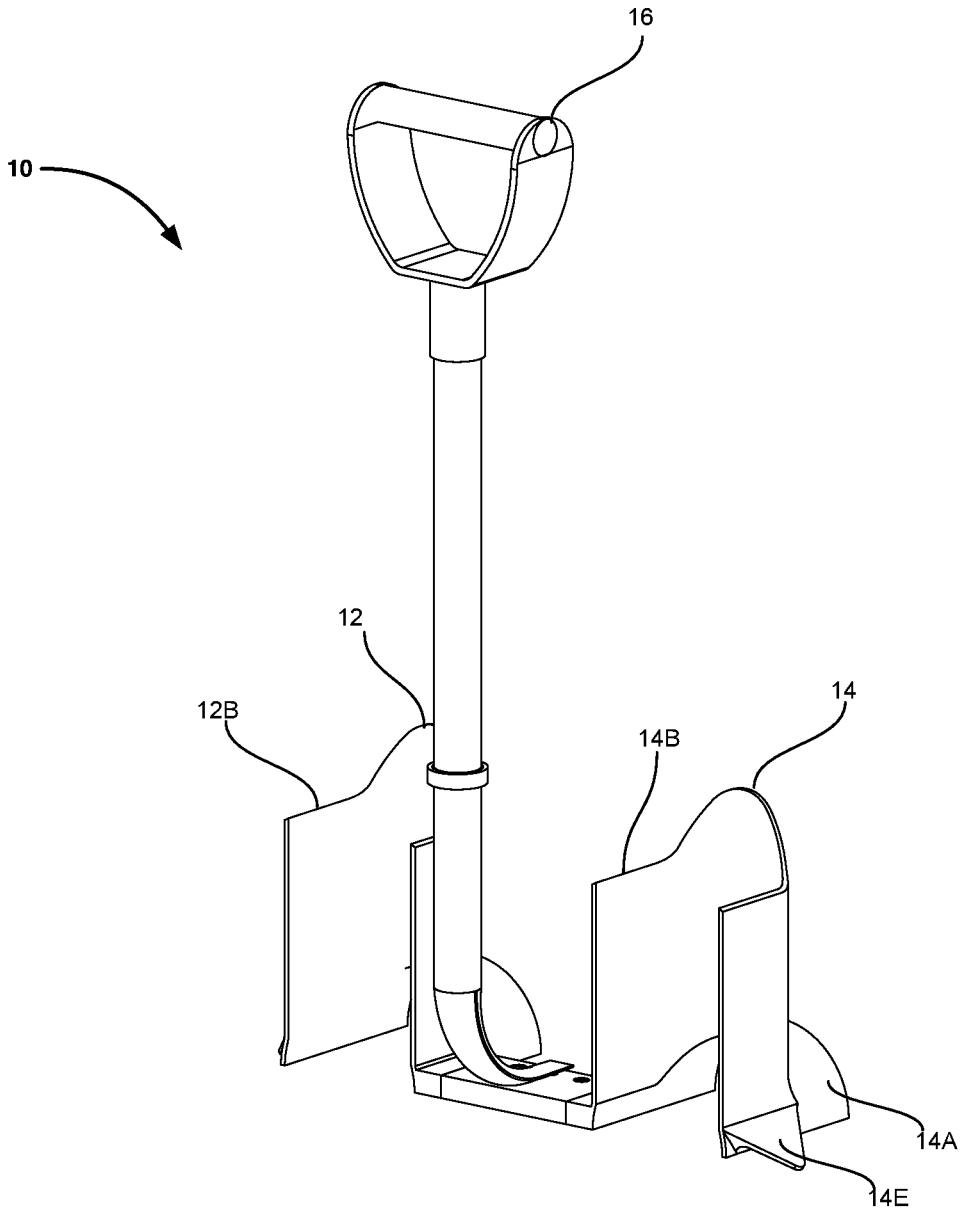
FIG. 3 illustrates another isometric view of apparatus 10, in accordance with an embodiment of the present invention.
Figure 4:
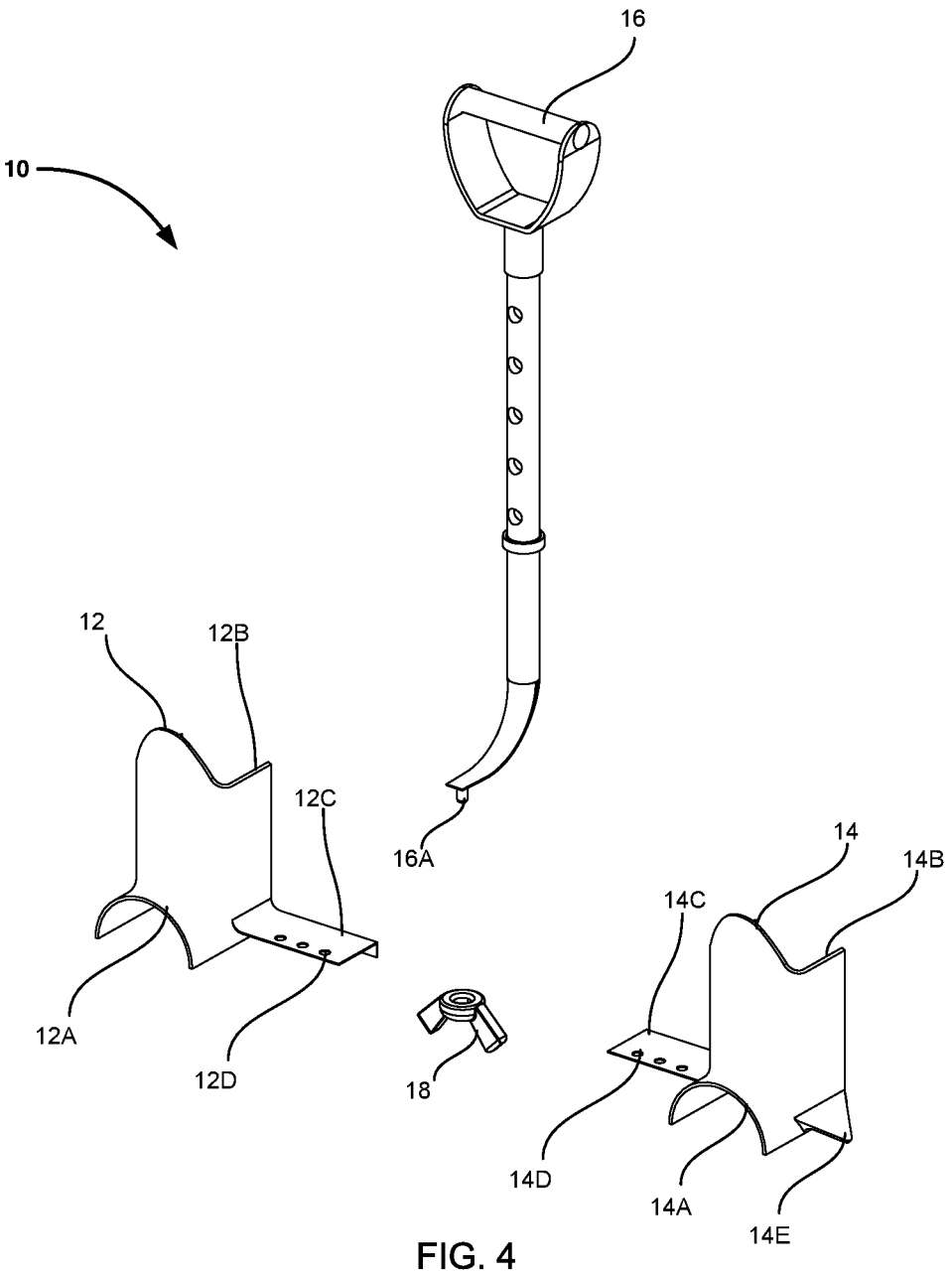
FIG. 4 illustrates an exploded isometric view of apparatus 10, in accordance with an embodiment of the present invention.

Referring now to FIGS. 1 through 5, where the present invention is generally referred to with numeral 10, it can be observed that an apparatus for assisting in donning apparels 10, hereinafter referred to as apparatus 10, in accordance with an embodiment of the present invention, comprises a first brace element 12, a second brace element 14 connectable to first brace element 12, a handle 16 connectable to first brace element 12 and second brace element 14, and a wing nut 18 for assembling first brace element 12 and second brace element 14 with handle 16.

Apparatus 10 comprises first brace element 12 and second brace element 14. First brace element 12 and second brace element 14 are connectable to each other wherein first brace element 12 and second brace element 14 form supports for installing a garment thereon for allowing a user to insert user's foot in the garment while the garment is held by first brace element 12 and second brace element 14.

First brace element 12 includes a first foot accommodating section 12A and second brace element 14 includes a second foot accommodating section 14A that defines a foot accommodating region. In an assembled configuration of apparatus 10, as seen in FIG. 1, first foot accommodating section 12A and second foot accommodating section 14A define an area in which the user can insert his or her feet. In accordance with an embodiment of the present invention, first foot accommodating section 12A and second foot accommodating section 14A each have a semicircular cross section. However, it is to be noted that first foot accommodating section 12A and second foot accommodating section 14A are not limited to having a semi-circular cross section, and can have any other cross section that allows user's feet to be optimally inserted into the foot accommodation area defined by the foot accommodating sections.

Figure 5:
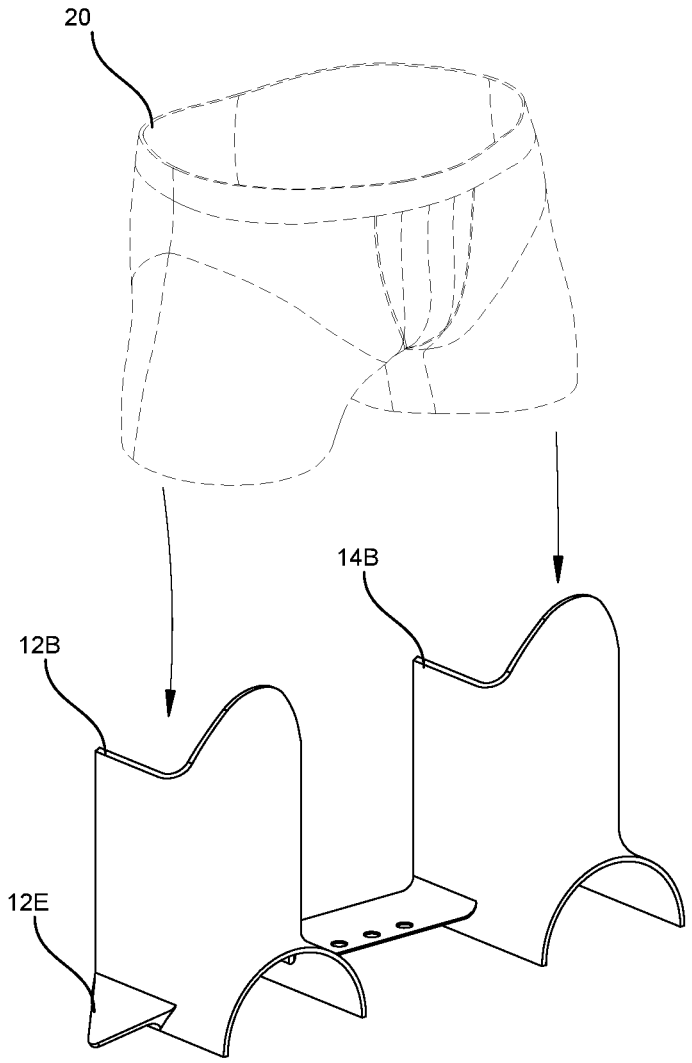
FIG. 5 illustrates a schematic view of garment 20 being fitted onto the present invention, in accordance with an embodiment of the present invention.

First brace element 12 includes a first garment installation section and second brace element 14 include a second garment installation section 14B extending from each of first foot accommodating section 12A and second foot accommodating section 14A, respectively, for allowing a garment to be installed thereon, as seen in FIG. 5. In accordance with an embodiment of the present invention, each of first garment installation section 12B and second garment installation section 14B each have a rectangular cross section. However, it is to be noted that first garment installation sections 12B and second garment installation section 14B are not limited to having a rectangular cross section and can have any other cross section that allows user's garment to be supported thereon.

First brace element 12 includes a first connector flange 12C and second brace element 14 includes a second connector flange 14C each having a plurality of openings configured thereon. The openings are further defined as first element openings 12D and second element openings 14D. More specifically, the first connector flange 12C and second connector flange 14C extend from first foot accommodating section 12A and second foot accommodating section 14A, respectively, in accordance with an embodiment of the present invention.

Apparatus 10 further comprises a handle 16. Handle 16 is connectable to first brace element 12 and second brace elements 14 for pulling up first brace element 12 and second brace element 14 together, in an assembled configuration thereof. Resulting in having garment 20 being installed thereon, thereby assisting the user in donning garment 20. Handle 16 is an elongated element having a substantially L-shaped configuration. At an operative bottom end of handle 16, a fastener 16A is configured, wherein fastener fits into aligned first element openings 12D and second element openings 14D configured on of first brace element 12 and second brace element 14. In an embodiment, fastener 16A is a screw having thread formations configured thereon.

Apparatus 10 further comprises wing nut 18. Wing nut 18 is configured to fit onto fastener 16A. Fitment of wing nut 18 on fastener 16A, when fastener 16A is inserted in aligned first element opening 12D and second element opening 14D on first connector flange 12C and second connector flange 14C, facilitates assembly of first brace element 12 and second brace element 14 with handle 16.

In an embodiment, plurality of first element openings 12D and second element openings 14D on first connector flange 12C and second connector flange 14C, respectively, are aligned in accordance with a measurement of user's hips for facilitating the user to comfortably put on garment using apparatus. Referring to FIG. 5, garment 20 is fitted on first garment installation section 12B and second garment installation section 14B. Once garment 20 is installed on first garment installation section 12B and second garment installation section 14B, the user can then insert their feet into the space defined between garment 20 and first garment installation section 12B and second garment installation section 14B. The user's feet can be then pushed thereinto until they reach first foot accommodating section 12A and second foot accommodating section 14A, subsequent to which handle 16 is used to pull garment 20 up to fit on the user's hips. Thereby resulting in aiding a user in donning apparels without the need to be very mobile due to various circumstances. Additionally, it can be seen that first brace element 12 includes a first element support 12E and second element 14 includes a second element support 14E. First element support 12E and second element support 14E are mounted at a lower section of the respective element. First element support 12E and second element support 14E aid in maintaining the present invention stable when on a ground surface. First element support 12E and second element support 14E help to make donning clothing even easier and secure for users.

It should be understood that first brace element 12 and second brace element 14 cover the shins of a person and as such may be shin covers. The portions that cover the feet and shins or more specifically, first brace element 12 and second brace element 14 of the person are coupled together by a coupling member such as first connector flange 12C and second connector flange 14C which attach to a mid-point of each of first foot accommodating section 12A and second foot accommodating section 14A or of first brace element 12 and second brace element 14.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an apparatus for assisting a user in donning apparel, said apparatus comprising:

a. a garment;

b. a first brace element;

c. a second brace element connectable to said first brace element, wherein said first brace element and said second brace element form supports for installing the garment thereon for allowing a user to insert user's foot in the garment while the garment is held by said first brace element and said second brace element, said first and second brace element cover the shins of the user, said first brace element and said second brace element are coupled together by a coupling member having a first connector flange and a second connector flange which attach to a mid-point of each of a first foot accommodating section and a second foot accommodating section, said first brace element includes the first connector flange having first element openings and said second brace element includes the second connector flange having second element openings configured thereon, said first connector flange and second connector flange extending from said first foot accommodating section and said second foot accommodating section, respectively; and d. a handle connectable to said first brace element and second brace elements for pulling up said first brace element and second brace elements in an assembled configuration thereof and having the garment installed thereon, thereby assisting the user in wearing the garment, wherein said handle comprises a fastener configured at an operative bottom end thereof, wherein said fastener fits into aligned first element openings of said first brace element and second element openings and of said second brace element.

2. The system according to claim 1, said first brace element includes the first foot accommodating section and said second brace element includes the second foot accommodating section that each define a foot accommodating region.

3. The system according to claim 2, wherein said first foot accommodating section and said second foot accommodating section have a semi-circular cross section.

4. The system according to claim 1, said first brace element includes a first garment installation section and said second brace element includes a second garment installation section extending from said first foot accommodating section and said second foot accommodating section, respectively, for allowing the garment to be installed thereon.

5. The system according to claim 4, wherein said first garment installation section and said second garment installation section have a rectangular cross section.

6. The system according to claim 1, wherein said first element openings and said second element openings on said first connector flange and said second connector flange, respectively, are aligned in accordance with a measurement of user's hips for facilitating the user to comfortably put on said garment using said apparatus.

7. The system according to claim 1, further comprising a wing nut for engaging with said fastener to assemble said handle and said first brace and second brace element.

8. The system according to claim 1, wherein said first element further includes a first element support and said second element further includes a second element support each adapted to provide stability to said apparatus.

* * * * *